US009304474B2

(12) United States Patent
Sakashita et al.

(10) Patent No.: US 9,304,474 B2
(45) Date of Patent: Apr. 5, 2016

(54) IMAGE FORMING APPARATUS

(71) Applicants: Takeshi Sakashita, Hyogo (JP); Masanari Fujita, Osaka (JP); Yuuji Meguro, Hyogo (JP); Naoki Takai, Osaka (JP); Daisuke Hasebe, Kanagawa (JP)

(72) Inventors: Takeshi Sakashita, Hyogo (JP); Masanari Fujita, Osaka (JP); Yuuji Meguro, Hyogo (JP); Naoki Takai, Osaka (JP); Daisuke Hasebe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/633,300

(22) Filed: Feb. 27, 2015

(65) Prior Publication Data

US 2015/0248099 A1 Sep. 3, 2015

(30) Foreign Application Priority Data

Feb. 28, 2014 (JP) ..... 2014-038828

(51) Int. Cl.
*G03G 15/00* (2006.01)

(52) U.S. Cl.
CPC ..... *G03G 15/75* (2013.01)

(58) Field of Classification Search
None
See application file for complete search history.

(56) References Cited

U.S. PATENT DOCUMENTS

| | | | | |
|---|---|---|---|---|
| 7,778,568 | B2 | 8/2010 | Sakashita et al. | |
| 7,869,751 | B2 | 1/2011 | Adachi et al. | |
| 8,005,412 | B2 | 8/2011 | Sakashita et al. | |
| 2006/0226745 | A1* | 10/2006 | Kimura | 312/293.1 |
| 2007/0098472 | A1* | 5/2007 | Saeki et al. | 399/400 |
| 2013/0011158 | A1 | 1/2013 | Meguro et al. | |
| 2013/0051854 | A1 | 2/2013 | Sakuma et al. | |
| 2014/0079434 | A1 | 3/2014 | Sakashita et al. | |

FOREIGN PATENT DOCUMENTS

| | | | | |
|---|---|---|---|---|
| JP | 2000-229746 | * | 8/2000 | G03G 15/00 |
| JP | 2004-191438 | | 7/2004 | |
| JP | 2007-178760 | | 7/2007 | |

* cited by examiner

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

An image forming apparatus is disclosed, including a movable image bearer bearing an image thereon which is transferred to a recording medium when the image comes into contact with the recording medium; and a twining prevention member which is arranged in the vicinity of the image bearer on the side downstream of a portion of the contact between the recording medium and the image bearer in a moving direction of the image bearer to prevent the recording medium from twining around the image bearer, wherein the twining prevention member includes, in the portion of the contact with the recording medium, a high friction resistance portion which regulates movement of the recording medium.

19 Claims, 8 Drawing Sheets

IMAGE FORMING APPARATUS

TECHNICAL FIELD

The present invention relates to copy machines, facsimile machines, printers, and multifunction peripherals which include a multiple number of these functions.

BACKGROUND ART

With an intermediate transfer body or a photoconductor (which may be a belt, a roller, etc.) that is a belt-shaped image bearer used in an electrophotography-type image forming apparatus, a sheet may twine around the image bearer due to electrostatic adsorption force of the sheet onto the image bearer or curling of the sheet for toner to be transferred onto the sheet. When the apparatus is further operated while the sheet is twined around the image bearer, the sheet may get into the apparatus and, in the worst case, a component damage, etc., may occur. Therefore, it is known to provide a sheet twining prevention structure which prevents the sheet from getting into the apparatus when the sheet twines around the image bearer.

More specifically, a technique is known such that a separation claw which includes functions of contacting with and separating from a belt is provided to suppress deterioration of a toner image forming face as well as to ensure that a printing medium is peeled off a toner image forming face and the separation claw is abutted against a transfer belt for a short time at which a leading edge of the sheet is peeled off the transfer belt and damage to the belt is suppressed to a minimum level (see Patent Document 1, for example).

PATENT DOCUMENT

Patent Document 1: JP2007-178760A

DISCLOSURE OF THE INVENTION

An object of the present invention is to provide an image forming apparatus which makes it possible to prevent stoppage and damage to an apparatus when a sheet twines around an image bearer in a simple configuration at no additional cost.

According to an embodiment of the invention, an image forming apparatus is provided, including, a movable image bearer bearing an image thereon which is transferred to a recording medium when the image comes into contact with the recording medium; and a twining prevention member which is arranged in the vicinity of the image bearer on the side downstream of a portion of the contact between the recording medium and the image bearer in a moving direction of the image bearer to prevent the recording medium from twining around the image bearer, wherein the twining prevention member includes, in the portion of the contact with the recording medium, a high friction resistance portion which regulates movement of the recording medium.

The present invention makes it possible to prevent stoppage and damage to an apparatus when a sheet twines around an image bearer in a simple configuration at no additional cost.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Below embodiments of the present invention are described with reference to the drawings. In the present specification and drawings, elements having substantially the same functional features are given the same letters, so that repeated explanations will be omitted.

Figure 1:
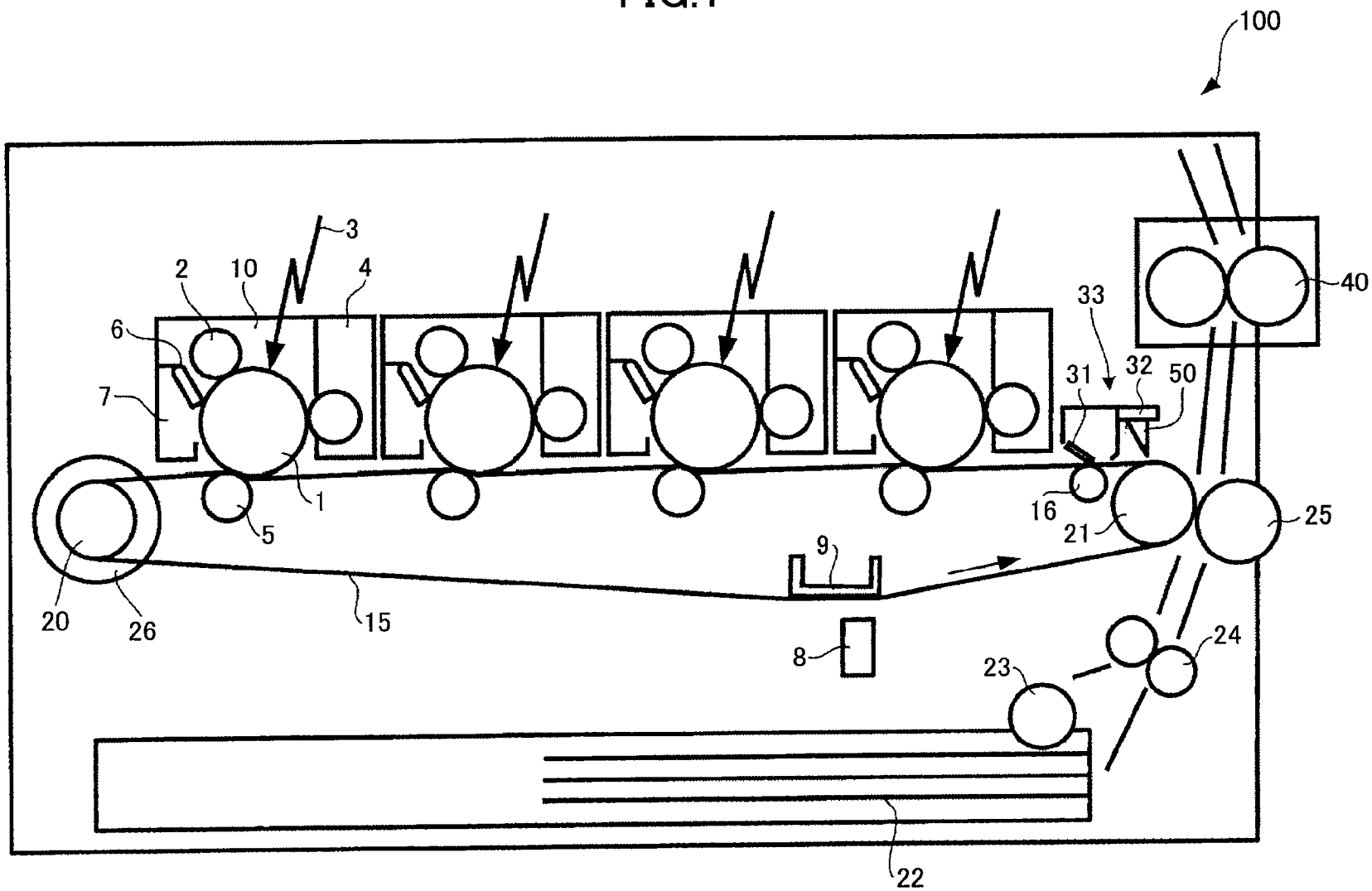
FIG. 1 is a schematic diagram illustrating an image forming apparatus to which one embodiment of the present invention can be applied.

FIG. 1 shows an image forming apparatus 100 to which one embodiment of the present invention can be applied. Shown therein are cylindrically-shaped photoconductors 1 with a diameter of 24 mm that rotate at the circumferential speed of 100-180 mm/sec. Roller-shaped charging apparatuses 2, which are charging units, abut against the surface of the photoconductors 1 and the charging apparatuses 2 undergo a slave rotation by rotating of the photoconductors 1. A direct current, or a bias in which an alternating current is superimposed on the direct current is applied to the charging apparatuses 2 from a high-voltage power supply (not shown), which causes the photoconductors 1 to be charged uniformly to a surface potential of −200V to −1000V.

To the photoconductors 1 which are charged by the charging apparatuses 2 is then sent image information via exposure 3 by an exposure apparatus (not shown) which is a latent image forming unit, thereby causing an electrostatic latent image to be formed on the surface thereof. The process of exposure 3 is conducted by an LED, a laser beam scanner using a laser diode, etc. Single-component contact developing-type developing devices 4 which are developing units cause the electrostatic latent image on the photoconductors 1 to be imaged as a toner image by a predetermined developing bias provided by a high-voltage power supply (not shown). The photoconductors 1 from which the developed image are transferred onto a recording medium such as a sheet, etc., is cleaned by cleaning apparatuses 7 which include cleaning blades 6.

Also shown are process units 10 into which are integrated the photoconductors 1, the charging apparatuses 2, the developing devices 4, and the cleaning apparatuses 7 that are described above. In the image forming apparatus 100 shown in the present embodiment, four of the process units 10 are parallelly arranged, and visible images are formed on the respective photoconductors 1 in the order of black, yellow, magenta, and cyan at the time of forming a full-color image. The respectively-colored visible images are successively transferred in a superimposed manner, by primary transfer members 5, onto an intermediate transfer belt 15 as an image bearer which abuts against the respective photoconductors 1, thereby causing the full-color image to be formed on the intermediate transfer belt 15. Image information such as the image density, the positional relationship, etc., of the respective colors that are transferred onto the intermediate transfer belt 15 is read by a light reflection type sensor 8. Here, an opposing member 9 is arranged at a position opposing the sensor 8 to stabilize the behavior of the intermediate transfer belt 15.

While charging blades, charging sponge rollers, metal rollers, etc., can be used as the primary transfer members 5, in the present embodiment, the metal rollers are used with a diameter of 8-12 mm, which are arranged in an offset manner in the vertically upward direction on the upstream side in the moving direction of the intermediate transfer belt 15. A predetermined transfer bias of +50 to +1000V is applied in common by a singular high-voltage power supply (not shown in the primary transfer members 5) to the photoconductors 1 to thereby form a transfer electric field via the intermediate transfer belt 15 and causes toner images on the photoconductors 1 to be primary transferred onto the intermediate transfer belt 15.

The intermediate transfer belt 15 is stretched over a drive roller 21 which also serves as a secondary transfer opposing roller; a metallic cleaning opposing roller 16, the four primary transfer members 5, and a tension roller 20. The intermediate transfer belt 15 is driven to travel in a direction indicated with an arrow in FIG. 1 by the drive roller 21 being rotationally driven by a drive motor (not shown). The tension of the intermediate transfer belt 15 is applied by a spring (not shown) which is provided on both sides of the tension roller 20. The tension roller 20 is configured with an aluminum pipe with a diameter of 16-21 mm, to both ends of which the aluminum pipe is press-fitted a flange 26 with a diameter of 22 mm, and the flange 26 functions as a regulation member which regulates meandering of the intermediate transfer belt 15.

As the intermediate transfer belt 15, a resin film-shaped endless belt is used, wherein a conductive material such as carbon black, ionic conductive resin, etc., is dispersed in PVDF (polyvinylidene difluoride), ETFE (ethylene tetra fluoro ethylene copolymer), PI (polyimide), PAI (polyamide-imide), PC (polycarbonate), polyester, etc. While a belt with the thickness of 90-160 μm and the width of 230 mm is used for achieving the tensile elasticity of 1000-4500 MPa in the present embodiment, the width can be set freely with a paper width, etc.

Also shown is a transfer belt cleaning unit 33 which conducts cleaning by scraping, by a cleaning blade 31 which is a cleaning member, the toner remaining on the intermediate transfer belt 15 after the transfer. Urethane rubber with a thickness of 1.5-3 mm and a rubber hardness of 65-80 is used as the cleaning blade 31, which is counter-abutted against the intermediate transfer belt 15. The scraped toner remaining on the intermediate transfer belt 15 after the transfer passes through a toner conveyance path (not shown) so as to be stored in a transfer body waste toner storage unit (not shown). The respective rollers over which the intermediate transfer belt 15 is stretched is supported on both sides of the intermediate transfer belt 15 by transfer belt unit side plates (not shown). As the cleaning member, a roller-shaped one, an impeller-shaped one, etc., as well as a blade may be used.

At the position opposing the drive roller 21 via the intermediate transfer belt 15 is arranged, as a transfer member, a secondary transfer roller 25, which forms a transfer nip for transferring the image on the intermediate transfer belt 15 onto a transfer material 22 (below described). The secondary transfer roller 25 is configured to have a diameter of 19-22 mm and a width of 222 mm (the width can be set freely with a paper width, etc.) by coating an elastic body with a conductive material onto a cored bar of a metal such as stainless steel, etc., with a diameter of 6 mm. While a conductive roller, an electrically-conductive type roller (EPDM), etc., may be used as the material, an Asker C roller with a diameter of 20 mm and a hardness of 35-50 is used in the present embodiment. The measured resistance value of the secondary transfer roller 25 is calculated from the value of a current which flows between a conductive metal plate on which the secondary transfer roller 25 is mounted and the core bar when a voltage of 100-1000 V is applied therebetween.

Figure 2:
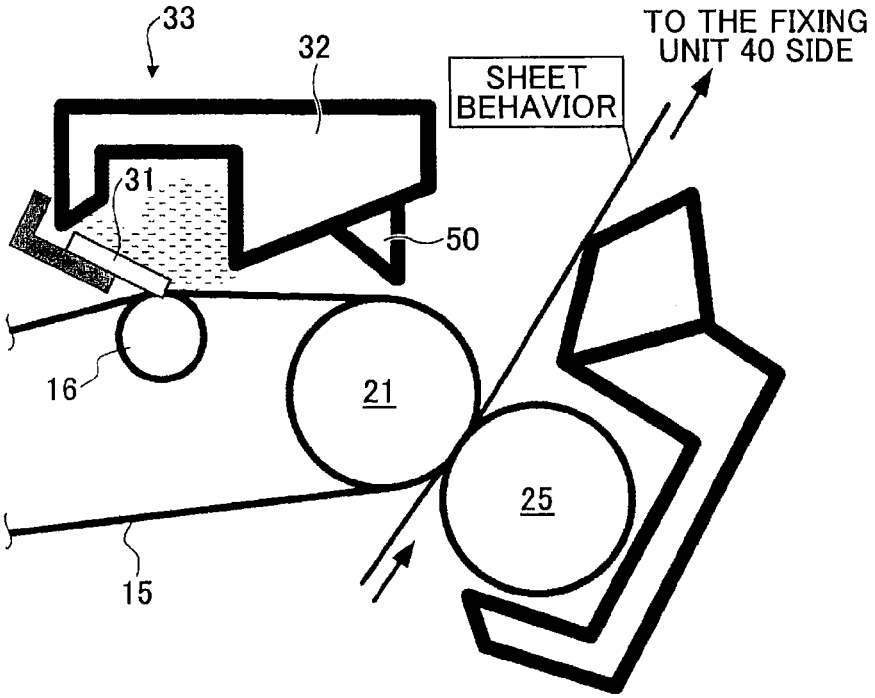
FIG. 2 is a schematic diagram for explaining the behavior of a transfer material after a secondary transfer according to one embodiment of the present invention.

The transfer material 22, which is a recording medium stored at a lower portion of the image forming apparatus 100, is fed by a sheet-feeding roller 23 and a registration roller pair 24 in alignment with the timing at which the leading edge portion of the toner image on the surface of the intermediate transfer belt 15 arrives at the secondary transfer position. Then, a predetermined transfer bias is applied by a high-voltage power supply (not shown) to cause the toner image on the intermediate transfer belt 15 to be secondary-transferred onto the transfer material 22. In the present embodiment, in which a vertical-type path is adopted for paper feeding, the transfer material 22 onto which the image was transferred is separated from the intermediate transfer belt 15 due to the curvature of the drive roller 21 as shown in FIG. 2. The transfer material 22 onto which the image was transferred is sent to a fixing unit 40 which causes the image to be fixed thereto with heat and pressure, after which the transfer material 22 is discharged onto a paper ejection tray (not shown).

Figure 3:
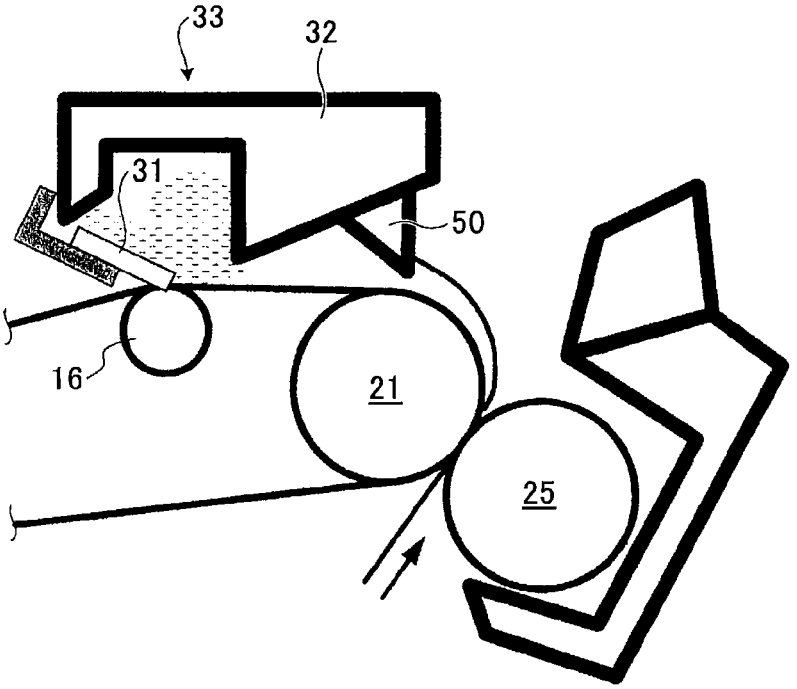
FIG. 3 is a schematic diagram illustrating the state in which a twining prevention member according to one embodiment of the present invention prevents the transfer material from entering the apparatus.

As shown in FIG. 3, in the vicinity of the end portion on the upstream side in the sheet conveyance direction of the transfer belt cleaning unit 33 is arranged a twining prevention member 50 which prevents the transfer material 22 from entering the cleaning blade 31 when a separation failure of the transfer material 22 occurs. FIG. 3 shows the state in which the transfer material 22 is prevented from entering the cleaning blade 31 by the twining prevention member 50 which is supported by the supporting member 32. The twining prevention member 50 may be configured to be provided as a single unit in the center portion in the width direction of the transfer material 22; as two units, one each in the respective end portions in the width direction of the transfer material 22; as a total of three units in the center portion and in the respective end portions; or as four or more units. The twining prevention member 50 is configured with a resin material such as ABS, polyacetal, polycarbonate, polyamide, etc., that is generally used in mechanical components.

Figure 4:
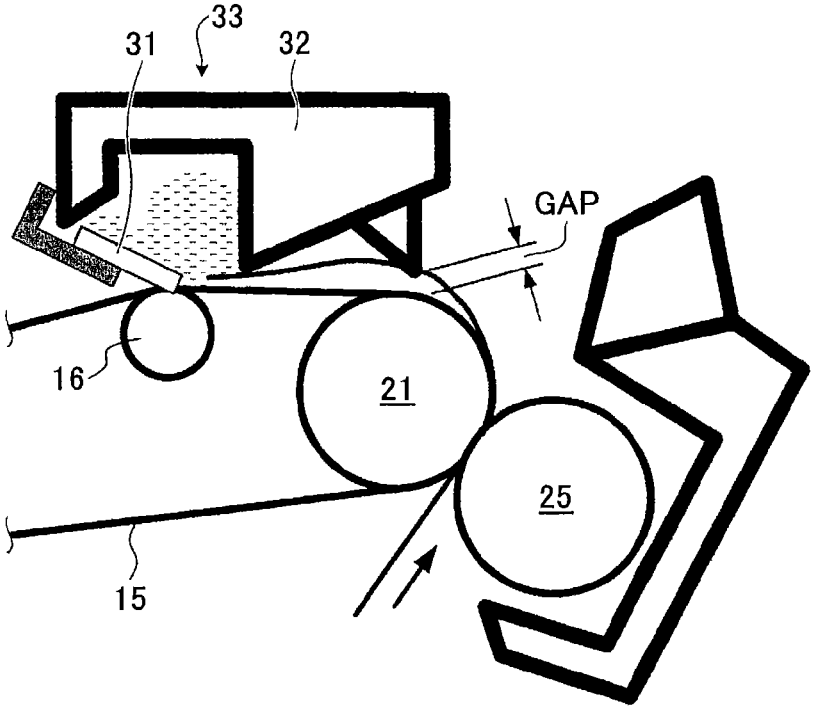
FIG. 4 is a schematic diagram for explaining the problems of a related-art twining prevention member.

However, even for a configuration in which the twining prevention member 50 is provided, the transfer material 22 which sticks so strongly as to make a small floating amount as shown in FIG. 4 causes the transfer material 22 to slip through the GAP (shown) between the twining prevention member 50 and the intermediate transfer belt 15. A factor which makes the floating amount of the transfer material 22 small includes curling of the end portion of the transfer material due to double-sided image formation, weakness in stiffness of the transfer material, high humidity, etc.

There is a problem that the transfer material 22 abutting against the intermediate transfer belt 15 may cause the intermediate transfer belt 15 to deteriorate, and there is also a problem that providing a contact/separation mechanism may cause costs to increase and the intermediate transfer belt 15 to deteriorate even though there is an improvement over the case of abutting constantly. Moreover, with a configuration of providing a gap between the twining prevention member 50 and the intermediate transfer belt 15, the transfer material 22 sticks so strongly to the intermediate transfer belt 15 as to make a small floating amount to cause the transfer material 22 to slip though the gap between the sheet twining prevention member 50 and the intermediate transfer belt 15. Then, there is a problem that, in the worst case, the cleaning blade 31 may be damaged by the transfer material 22.

Figure 5:
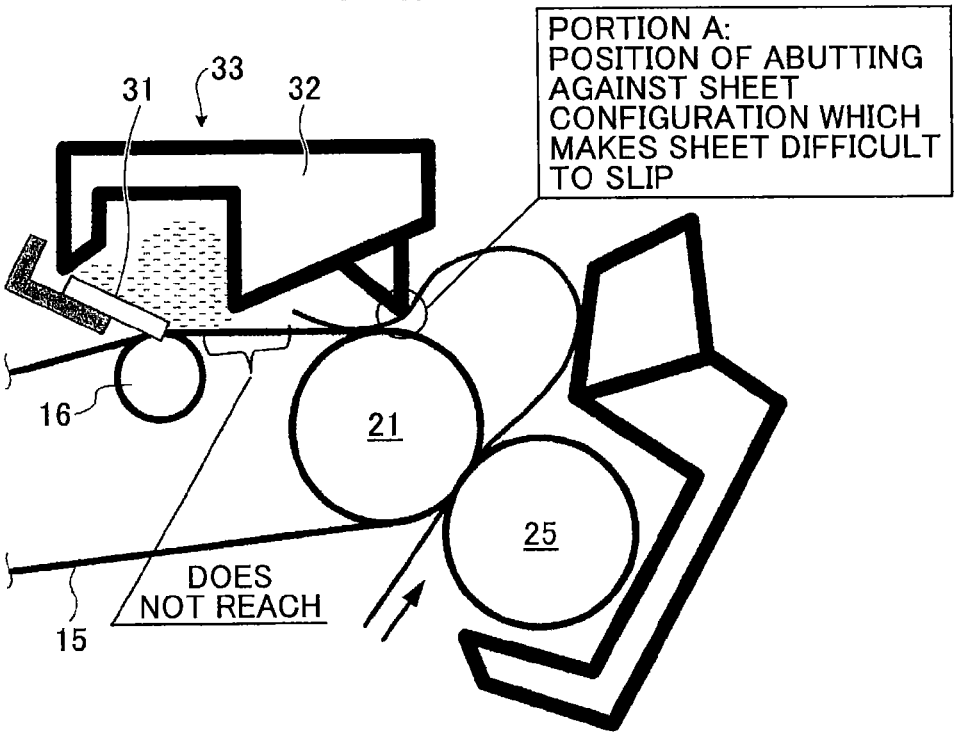
FIG. 5 is a schematic diagram for explaining the advantageous effects of the present invention.

An image forming apparatus according to the present embodiment is aimed at preventing the transfer material 22 from getting into the apparatus when it slips in between the sheet twining prevention member 50 and the intermediate transfer belt 15 in a simple configuration at no additional cost. Therefore, as shown in FIG. 5, the apparatus is configured to set the sliding load of a Portion A in the twining prevention member 50 high and to cause the transfer material 22 to stop before reaching the cleaning blade 31 even when the transfer material 22 slips through the gap described above. Below a configuration according to the present embodiment is described.

Figure 6:
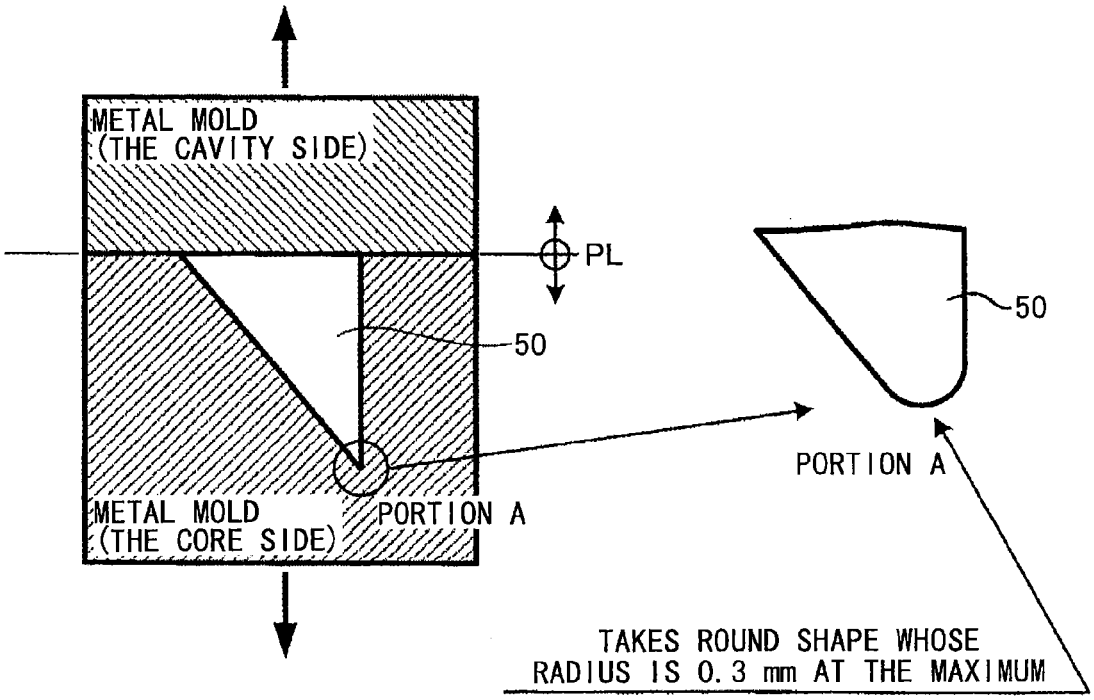
FIG. 6 is a schematic diagram for explaining a related-art resin-made twining prevention member which is formed by a metal mold.

Normally, when molding the resin-made twining prevention member 50, two metal molds are combined to cast a melted resin material into the combined metal molds to mold; dividing the metal mold at the parting line shown in FIG. 6 may cause a burr to be formed. Moreover, forming a metal mold by curving may cause the Portion A, which is a contact portion in contact with the transfer material 22, to take a round shape whose radius is 0.3 mm at the maximum; this round shape may cause the sliding load with the transfer material 22 to be reduced.

Figure 7:
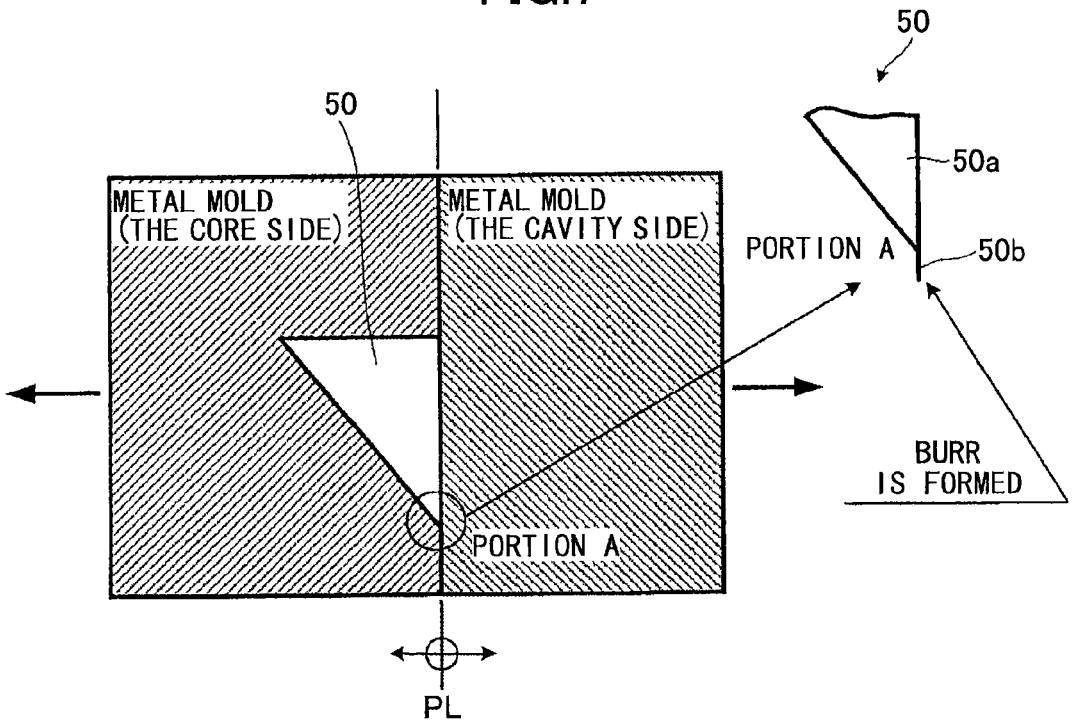
FIG. 7 is a schematic diagram for explaining a twining prevention member which is used in a first embodiment of the present invention.

Then, according to the first embodiment of the present invention as shown in FIG. 7, it is configured such that a burr is formed in a Portion A which is a contact portion when a metal mold is divided at a parting line provided in a direction orthogonal to the metal mold shown in FIG. 6. In this way, a projection portion 50*b* may be formed as a high friction resistance portion with the burr at a portion opposing the intermediate transfer belt 15 of a base portion 50*a* of the twining prevention member 50, which is a resin. Normally the burr is pointed and the sliding load is very high relative to the transfer material 22, so that the transfer material 22 may be rubbed with the burr to prevent the transfer material 22 from entering the cleaning blade 31. This configuration makes it possible to cause the transfer material 22 to stop entering into the apparatus when the transfer material 22 slips in between the twining prevention material 50 and the intermediate transfer belt 15, making it possible to prevent stopping and damage of the image forming apparatus in a simple configuration at no additional cost.

Figure 8:
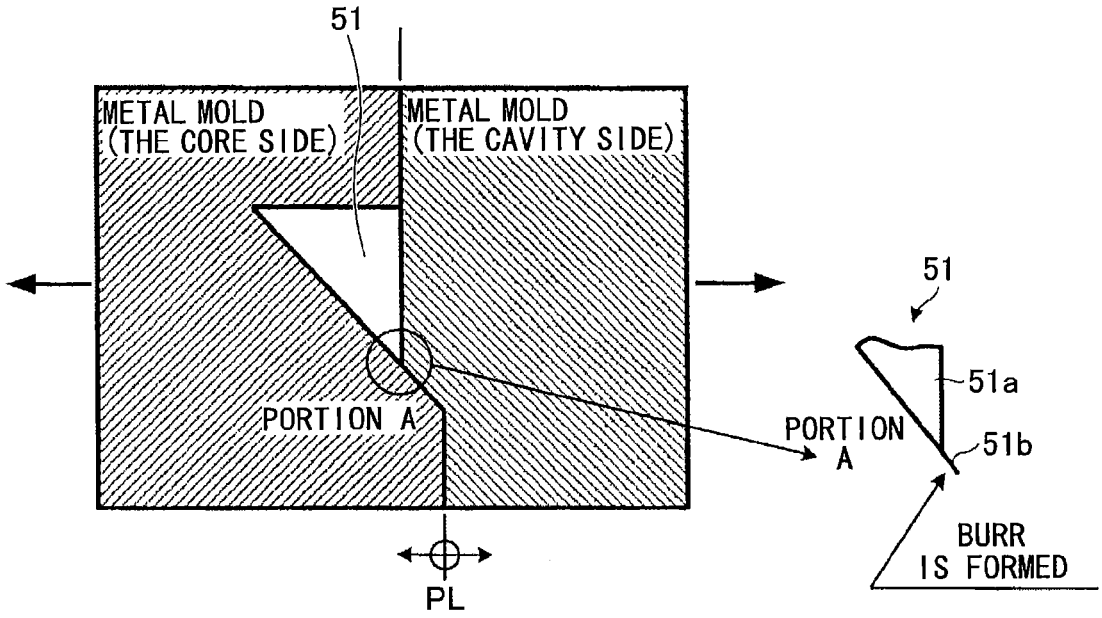
FIG. 8 is a schematic diagram for explaining the twining prevention member which is used in a second embodiment of the present invention.

FIG. 8 shows a second embodiment of the present invention. Compared to the first embodiment, this second embodiment differs in that the parting line is non-linearly formed, and otherwise the configurations are the same. As shown in FIG. 8, this configuration makes it possible to form a projection portion 51*b* as a high friction resistance portion formed by a burr at a portion opposing the intermediate transfer belt 15 of the base portion 51*a*. This makes it possible to mold a twining prevention member 51 such that the projection portion 51*b* is provided to be oriented at a predetermined angle to the upstream side in the travelling direction of the intermediate transfer belt 15. The twining prevention member 51 as a contact member that is the above-described resin makes it possible to achieve the same operational advantages as the first embodiment. Moreover, as the projection portion 51*a* which is integrally formed with the base portion 51*a* is formed at a predetermined angle, the transfer material 22 enters the apparatus at an angle such that it gets snagged on the projection portion 51*a* when the transfer material 22 enters the apparatus, causing the projection portion 51*b* to have a high friction resistance. Then, at the time of taking out the transfer material 22, the transfer material 22 is taken out at an angle at which the transfer material 22 follows the projection portion 51*a* causing it to have a low friction resistance. In this way, the transfer material 22 is further prevented from entering, making it possible to easily take out the transfer material 22.

Figure 9:
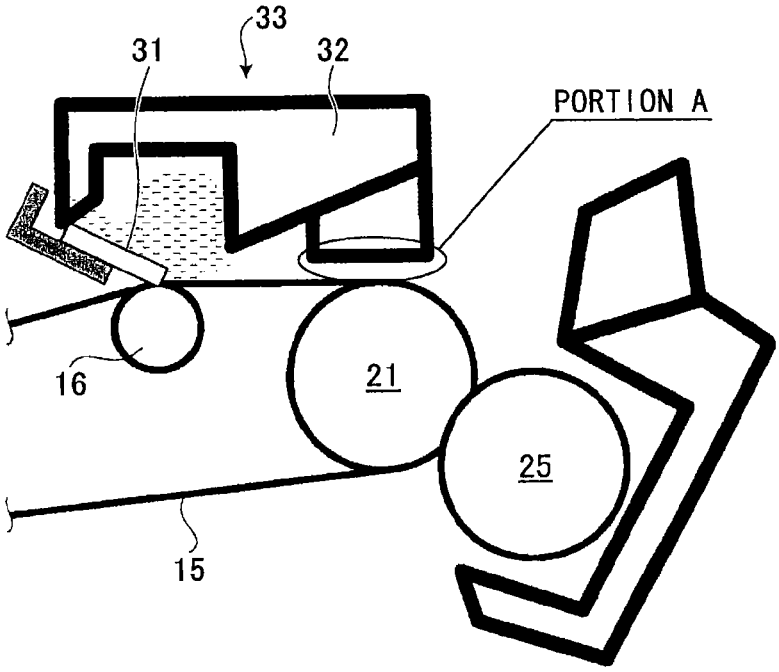
FIG. 9 is a schematic diagram for explaining further embodiments of the present invention.

According to the above-described first and second embodiments, an example is shown such that the high friction resistance portion which prevents the transfer material 22 from entering the apparatus is formed with the projection portions 50*b* and 51*b*, which are in line contact with the transfer material 22 at one location. However, the high friction resistance portion to which the present invention can be applied, can also be configured such that, in addition to the above-described projection portions 50*b* and 51*b*, a comb-tooth shaped portion is included as a Portion A and is in line contact with the transfer material 22 at multiple locations as shown in FIG. 9. This example is described below.

Figure 10:
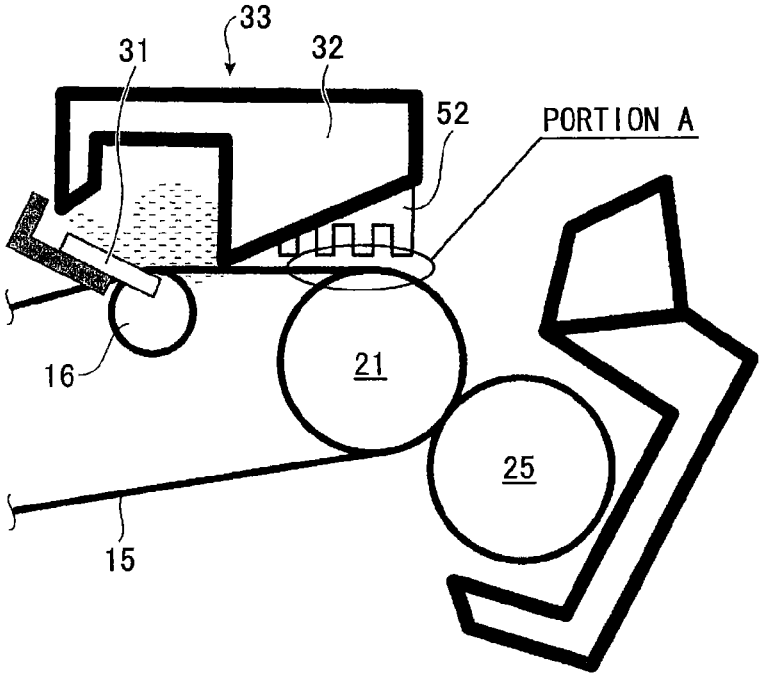
FIG. 10 is a diagram for explaining the twining prevention member which is used in a third embodiment of the present invention.

FIG. 10 shows a third embodiment of the present invention. According to the third embodiment, a twining prevention member 52 is used which includes a high friction resistance portion including comb-tooth shaped concave-convex portions in a Portion A which is a contact portion with the transfer material 22. According to this configuration, the twining prevention member 52 includes multiple concave-convex portions as a high friction resistance portion in a contact portion with the transfer material 22, so that the multiple edge portions cause the sliding load to increase, making it possible to further prevent the transfer material 22 from entering the apparatus relative to the first embodiment.

Figure 11:
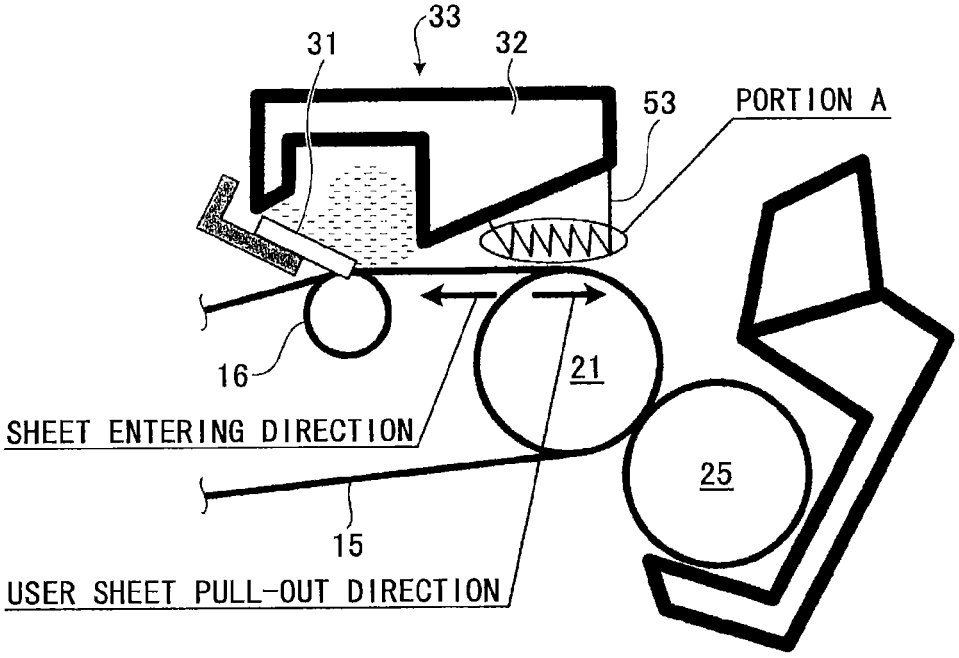
FIG. 11 is a diagram for explaining the twining prevention member which is used in a fourth embodiment of the present invention.

FIG. 11 shows a fourth embodiment of the present invention. Compared to the third embodiment, this fourth embodiment only differs in that a twining prevention member 53 instead of the twining prevention member 52 is used, and otherwise the configurations are the same. The twining prevention member 53 includes an acute-angle comb-tooth shaped high friction resistance portion such that it serves as a high friction resistance at the time the transfer material 22 enters the apparatus, while it serves as a low friction resistance at the time of taking out the transfer material 22. This configuration makes it possible to obtain the same operational advantages as the second embodiment as well as achieving the same operational advantages as the third embodiment.

Figure 12:
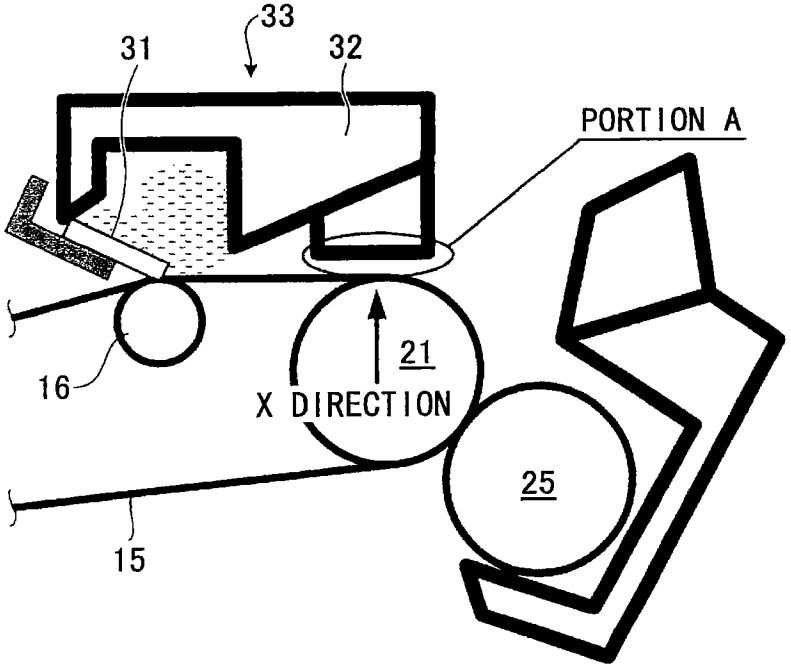
FIG. 12 is a schematic diagram for explaining yet further embodiments of the present invention.
Figure 12:
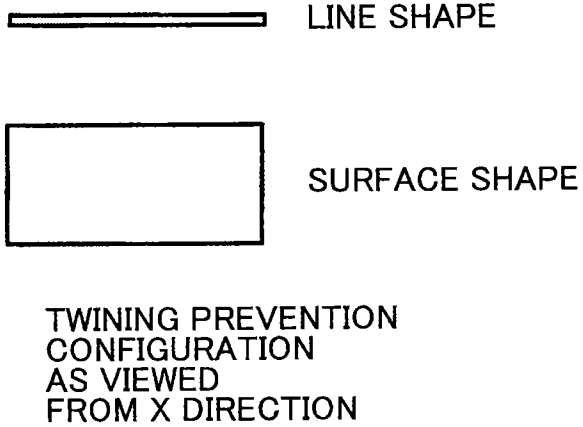

In the third and fourth embodiments described above, the twining prevention members 52 and 53 having a comb-tooth shaped portion in line contact at multiple locations as a high friction resistance portion have been shown. However, besides the above-described twining prevention members 52 and 53, the high friction resistance portion to which the present invention can be applied also includes a configuration which is in surface contact with the transfer material 22 as shown in FIG. 12. This example is described below.

Figure 13:
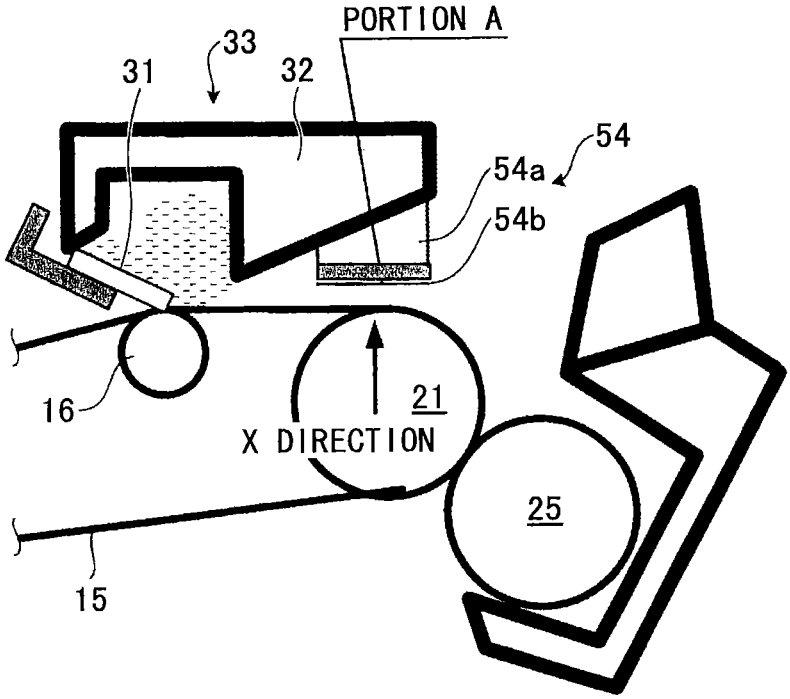
FIG. 13 is a schematic diagram for explaining the twining prevention member which is used in a fifth embodiment of the present invention.

FIG. 13 shows a fifth embodiment of the present invention. Compared to the third embodiment, this fifth embodiment only differs in that a twining prevention member 54 instead of the twining prevention member 52 is used, and otherwise the configurations are the same. The twining prevention member 54 includes a base portion 54*a*, and a high friction resistance portion 54*b* mounted thereto. The high friction portion 54*b*, which is made of foamed urethane rubber, EP rubber, silicone rubber, cork, etc., or a mixed material thereof, is configured such that a friction resistance value at a portion of contact with the transfer material 22 takes at least Ra 3.2. According to this configuration, the twining prevention member 54 is in surface contact with the transfer material 22, so that the sliding load increases, making it possible to further prevent the transfer material 22 from entering the apparatus relative to the third embodiment.

While preferable embodiments of the present invention are described above, the present invention is not limited to the above-described specific embodiments. Unless specifically restricted in the above descriptions, variations and changes are possible within the scope of the gist of the present invention as claimed.

For example, an image forming apparatus to which the present invention is applied is not limited to the above-described type of the image forming apparatus, so that it may be a different type of the image forming apparatus. In other words, the image forming apparatus to which the invention is applied may be a single unit printer or facsimile machine, or a multifunction peripheral thereof or a multifunction peripheral such a monochrome machine, a color machine related thereto. In addition, the image forming apparatus to which the invention is applied may be an image forming apparatus for use in forming an electrical circuit, an image forming apparatus for use in forming a predetermined image in the biotechnology field.

The advantageous effects which are described in the embodiments of the present invention merely list most suitable advantageous effects which result from the present invention.

While the intermediate transfer belt 15 has been shown as an image bearer in the above-described respective embodiments, the image bearer is not limited thereto, so that a drum-shaped one may be used instead of the intermediate transfer belt. Moreover, the present invention may be applied to an image forming apparatus which is configured to directly transfer, to the sheet, an image formed on a photoconductor drum as the image bearer. Moreover, a belt-shaped transfer member instead of the secondary transfer roller 25 and a brush-shaped cleaning member instead of the cleaning blade 31 may be used respectively, and some or all of the twining prevention members 50, 51, 52, 53, and 54 may be formed with metal, rubber, etc. Moreover, instead of a configuration in which the sheet is conveyed in the upward direction in the transfer nip between the intermediate transfer belt 15 and the second transfer roller 25, it may be configured to convey the sheet in the horizontal direction therein.

The present application is based on and claims the benefit of priority of Japanese Priority Application No. 2014-038828 filed on Feb. 28, 2014, the entire contents of which is hereby incorporated by reference.

The invention claimed is:

1. An image forming apparatus, comprising:

a movable image bearer bearing an image thereon which is transferred to a recording medium when the image comes in contact with the recording medium; and a twining prevention member which is arranged in the vicinity of the image bearer on the side downstream of a portion of the contact between the recording medium and the image bearer in a moving direction of the image bearer to prevent the recording medium from twining around the image bearer, wherein:

the twining prevention member includes, in the portion of the contact with the recording medium, a high friction resistance portion which regulates movement of the recording medium, the high friction resistance portion includes a projection portion which projects from a base portion of the twining prevention member, the twining prevention member is made of resin which is formed by a metal mold, and the projection portion is formed in a parting line of the metal mold.

2. The image forming apparatus as claimed in claim 1, wherein the parting line is disposed non-linearly to cause the projection portion to be disposed at a predetermined angle.

3. The image forming apparatus as claimed in claim 2, wherein the predetermined angle is at an angle such that the contact with the recording medium is made at a high friction resistance when the recording medium enters the twining prevention member and the contact with the recording medium is made at a low friction resistance when the recording medium is removed from the twining prevention member.

4. An image forming apparatus, comprising:

an image bearer which bears thereon an image;

a transfer member which forms a transfer nip for transferring, onto a sheet, the image on the image bearer;

a cleaning member which cleans the image bearer; and a contact member which is disposed on the side downstream of the transfer nip and on the side upstream of the cleaning member in a traveling direction of the image bearer to come in contact with the sheet when the sheet twines around the image bearer, wherein:

the contact member includes a base portion and a projection portion which projects from the base portion such that a leading edge thereof is oriented toward the upstream side in the traveling direction of the image bearer, the base portion includes a first plane and a second plane, the first plane and the second plane intersect with each other at a crossing position, the projection portion projects from the crossing position in a direction which extends along one of the first plane and the second plane.

5. The image forming apparatus as claimed in claim 4, wherein the projection portion and the base portion are integrally formed.

6. The image forming apparatus as claimed in claim 4, further comprising:

a supporting member which supports the cleaning member and the contact member.

7. The image forming apparatus as claimed in claim 6, wherein the cleaning member is a blade.

8. The image forming apparatus as claimed in claim 4, wherein the contact member is resin.

9. The image forming apparatus as claimed in claim 4, further comprising:

a gap between the image bearer and the leading edge of the projection portion.

10. An image forming apparatus, comprising:

an image bearer which bears thereon an image;

a transfer member which forms a transfer nip for transferring, onto a sheet, the image on the image bearer;

a cleaning member which cleans the image bearer; and a resin which is provided on the side downstream of the transfer nip and on the side upstream of the cleaning member in a traveling direction of the image bearer, wherein the resin includes a burr in a portion opposing the surface of the image bearer.

11. The image forming apparatus as claimed in claim 10, wherein the burr is arranged such that a leading edge thereof is oriented toward the side upstream in the traveling direction of the image bearer.

12. The image forming apparatus as claimed in claim 10, wherein a gap is provided between the image bearer and a leading edge of the burr.

13. The image forming apparatus as claimed in claim 10, wherein:

the image bearer comprises a belt that is supported by a plurality of rollers, and the burr faces one of the plurality of rollers via the belt.

14. The image forming apparatus as claimed in claim 4, wherein:

the projection portion has a constant thickness from the crossing position to the leading edge.

15. The image forming apparatus as claimed in claim 4, wherein:

the image bearer comprises a belt that is supported by a plurality of rollers, and the high friction resistance portion faces one of the plurality of rollers via the belt.

16. The image forming apparatus as claimed in claim 1, wherein:

the image bearer comprises a belt that is supported by a plurality of rollers, and the high friction resistance portion faces one of the plurality of rollers via the belt.

17. An image forming apparatus, comprising:

a movable image bearer bearing an image thereon which is transferred to a recording medium when the image comes in contact with the recording medium; and a twining prevention member which is arranged in the vicinity of the image bearer on the side downstream of a portion of the contact between the recording medium and the image bearer in a moving direction of the image bearer to prevent the recording medium from twining around the image bearer, wherein:

the twining prevention member includes, in the portion of the contact with the recording medium, a high friction resistance portion which regulates movement of the recording medium, wherein the high friction resistance portion comprises a comb-tooth shape, and the high friction resistance portion comes in contact with the recording medium at a high friction resistance when the recording medium enters the twining prevention member and comes in contact with the recording medium at a low friction resistance when the recording medium is removed from the twining prevention member.

18. An image forming apparatus, comprising:

a movable image bearer bearing an image thereon which is transferred to a recording medium when the image comes in contact with the recording medium; and a twining prevention member which is arranged in the vicinity of the image bearer on the side downstream of a portion of the contact between the recording medium and the image bearer in a moving direction of the image bearer to prevent the recording medium from twining around the image bearer, wherein:

the twining prevention member includes, in the portion of the contact with the recording medium, a high friction resistance portion which regulates movement of the recording medium, the high friction resistance portion is plane shaped, and the friction resistance value of the high friction resistance portion is at least Ra 3.2.

19. The image forming apparatus as claimed in claim 18, wherein the twining prevention member includes at least two members.

* * * * *